United States Patent [19]

Novak et al.

[11] Patent Number: 4,784,308

[45] Date of Patent: Nov. 15, 1988

[54] FASTENER DRIVING TOOL

[75] Inventors: Raymond F. Novak, Itasca; Ernest F. Schaudek, Franklin Park, both of Ill.

[73] Assignee: Duo-fast Corporation, Franklin Park, Ill.

[21] Appl. No.: 847,726

[22] Filed: Apr. 3, 1986

[51] Int. Cl.[4] ..... B25C 5/13

[52] U.S. Cl. ..... 227/130; 227/120; 227/130

[58] Field of Search ..... 227/130, 136, 120

[56] References Cited

U.S. PATENT DOCUMENTS

| | | | |
|---|---|---|---|
| 3,498,517 | 3/1970 | Novak | 227/130 X |
| 3,504,840 | 4/1970 | Wandel et al. | 227/130 |
| 3,512,454 | 5/1970 | Perkins | 227/130 X |
| 3,543,987 | 12/1970 | Obergfell | 227/136 |
| 3,563,438 | 2/1971 | Doyle et al. | 227/430 X |
| 4,319,705 | 3/1982 | Geist et al. | 227/136 X |

*Primary Examiner*—Paul A. Bell

*Attorney, Agent, or Firm*—Mason, Kolehmainen, Rathburn & Wyss

[57] ABSTRACT

A pneumatic fastener driving tool includes a return system for efficiently and rapidly returning a drive piston to the static position and effecting a fastener feeding operation. A housing defines a pressure fluid reservoir connected by a pneumatic control system to a first side of a drive piston to move a driver blade through a drive track in a drive stroke. A pressure fluid actuated fastener feed assembly advances fasteners along a feed path to the drive track. Following a drive stroke, the return system connects the reservoir to the second side of the drive piston for moving the drive piston and driver blade in a return stroke. The return system also connects the reservoir to the fastener feeding assembly for feeding of a fastener. The return system includes two separate return valves operable at different flow capacities and fluid pressures for drive piston return and for fastener feeding.

17 Claims, 6 Drawing Sheets

92
90
88
56
84
94
58
172
60
180
98
182
96
34
22
48
100
102
50
128
66
64
38
124
120
8
8
26
24
32
174
86
30
20
176
40
44
82
78
54
164
146
4
4
42
62
36
134
68
104

FASTENER DRIVING TOOL

The present invention relates to fastener driving tools and more particularly to improvements in return systems for drive piston return and fastener feeding.

Fluid pressure operated tools such as pneumatic tools may be used for driving fasteners such as nails. Typical tools include a housing defining a reservoir for pressure fluid and a drive piston carrying a fastener driving blade and movable in a cylinder from a static position in a fastener drive stroke and in the opposite direction in a return stroke. A pneumatic control system applies fluid pressure to one side of the drive piston in a drive stroke and vents that side of the drive piston to permit a return stroke.

Known fastener driving tools may utilize fluid pressure actuated fastener feeding assemblies for feeding fasteners along a feed path to the drive track of the tool. Tools have been provided with return systems operating after the completion of a drive stroke to use pressure fluid from the reservoir for the dual purposes of returning the drive piston to the static position and carrying out a fastener feeding operation in preparation for a subsequent drive stroke.

U.S. Pat. No. 3,543,987 discloses a fastener driving tool using a fluid pressure operated fastener feed assembly. The assembly includes a feed piston movable by a spring in a fastener drive stroke and movable by fluid pressure in a cocking stroke preparatory to feeding of a fastener. In this tool, fluid pressure for operation of the fastener feed assembly is supplied through ports in the cylinder wall and pressurization or venting of the fastener feed piston results from pressurization or venting of the drive cylinder and/or movement of the fastener drive piston.

U.S. Pat. No. 4,319,705 describes a fastener driving tool incorporating a return system in which fluid pressure is used both for drive piston return and for fastener feeding. This tool incorporates a single return valve operating following a drive stroke for applying pressure fluid both to return the drive piston and to move a fastener feed piston in a cocking stroke in opposition to a biasing force provided by fluid pressure.

It is desirable in fluid pressure operated fastener driving tools that high cycle rates be achieved without sacrifice of consistent, reliable operation. The return systems of known tools such as those disclosed in the two patents referred to above have been subject to difficulties in achieving fast operation. One reason for such difficulties is that the pressure and flow requirements for drive piston return are very different from the pressure and flow requirements for fastener feeding. Typically, a relatively high flow rate at a relatively low pressure is required to move the drive piston in a return stroke. Conversely, to move the fastener feed piston in a cocking stroke against the force of a spring or other bias, a relatively low capacity flow of higher pressure is necessary.

Because of the different pressure and flow requirements, sacrifices have been necessary in return systems for achieving both results, and these sacrifices have led to decreased speed of operation. For example, in a system like that of U.S. Pat. No. 4,319,705, one approach has been to introduce flow restriction between the return valve and the drive piston so that sufficient back pressure results to assure operation of the fastener feed piston. Such a flow restriction is undesirable. One disadvantage is that it slows the drive piston return stroke.

An important object of the present invention is to provide a fastener driving tool having an improved return system for moving the drive piston in a return stroke and for actuating a fastener feed assembly. Other important objects are to provide a fastener driving tool with a return system making possible fast operation without sacrificing efficiency and reliability; to provide a fastener driving tool return system in which different flow and pressure requirements are accommodated; to provide a fastener driving tool return system in which the tool is prepared for a subsequent fastener driving operation in a minimum of time; and to provide a fastener driving tool and return system overcoming disadvantages of those used in the past.

Briefly, the above and other objects and advantages of the present invention are achieved by providing a fastener driving tool including an improved return system. The tool includes a housing defining a pressure fluid reservoir, a fastener drive track and a fastener feed path. A fastener feed assembly actuated by pressure fluid advances fasteners along the fastener feed path to the drive track. A driver blade moves in the drive track for driving fasteners into a workpiece. A drive piston is connected to the driver blade and moves in a cylinder from a static position in a fastener drive stroke and in the opposite direction toward the static position in a return stroke. A pneumatic control system connects a first side of the drive piston to the reservoir during a drive stroke and vents the first side of the drive piston during a return stroke.

In accordance with important features of the present invention, there is provided an improved return system for connecting the reservoir to the second side of the drive piston to effect a return stroke and for connecting the reservoir to the fastener feed assembly to effect feeding of a fastener. The return system includes a drive piston return valve having an outlet connected to the second side of the drive piston as well as a fastener feed return valve having an outlet connected to the fastener feed assembly. Inlets of both of the return valves are connected to the reservoir, and the return system opens both of the return valves following a drive stroke and closes both of the return valves in the static position of the drive piston.

The invention, together with the above and other objects and advantages, may best be understood from the following detailed description of the preferred embodiment of the invention illustrated in the accompanying drawings wherein.

Figure 1:
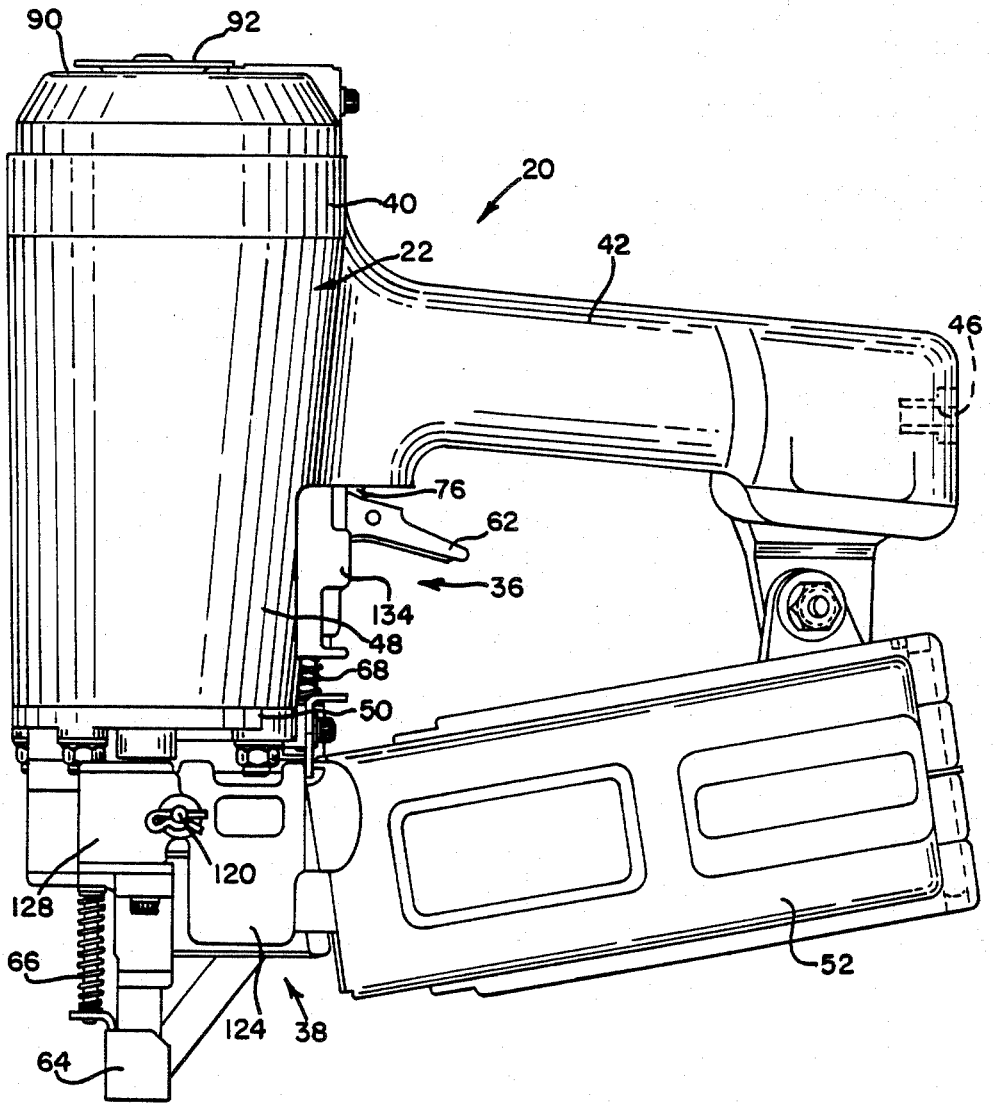
FIG. 1 is a side elevational view of a fastener driving tool constructed in accordance with the principles of the present invention.

Referring now to the drawings, there is illustrated a fastener driving tool designated as a whole by the reference numeral 20 and constructed in accordance with the principles of the present invention. In general, tool 20 includes a housing 22 within which a drive blade 24 is movable in a drive track 26 in order to drive fasteners 28 (FIG. 8) into a workpiece. A pneumatic control system generally designated as 30 controls movement of a drive piston 32 within a cylinder 34 from the static position illustrated in the drawings in a drive stroke and, in the opposite direction, in a return stroke. In accordance with the present invention, a return system generally designated as 36 reliably and rapidly prepares the tool for a subsequent fastener driving operation after each drive stroke by returning the drive piston 32 to the illustrated static position and by controlling the operation of a fastener feed assembly 38 to advance a fastener 28 to the drive track 26.

Housing 22 of tool 20 includes a body 40 having a handle portion 42 defining an internal chamber or reservoir 44 to which a pressure fluid such as compressed air is introduced by a conduit (not shown) connected to an inlet fitting 46. A head portion 48 contains the piston 32 and cylinder 34 and is attached to a nose 50 within which the drive track 26 is defined. A magazine 52 is supported by the handle 42 and nose 50 and contains a supply of fasteners 28 to be fed by the fastener feed assembly 38 one at a time to the drive track 26.

Figure 2:
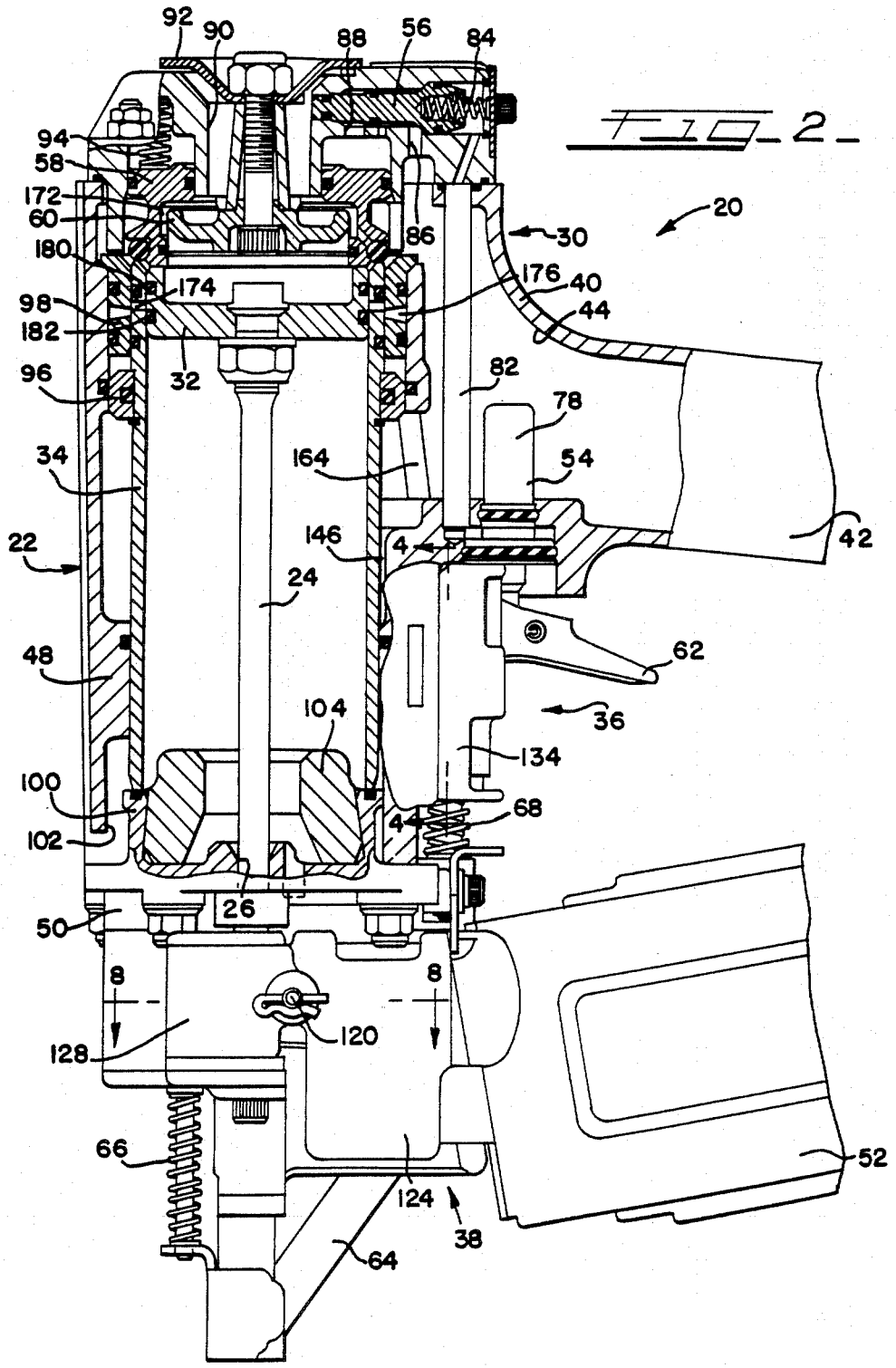
FIG. 2 is a vertical sectional view on an enlarged scale of part of the fastener driving tool of FIG. 1.
Figure 3:
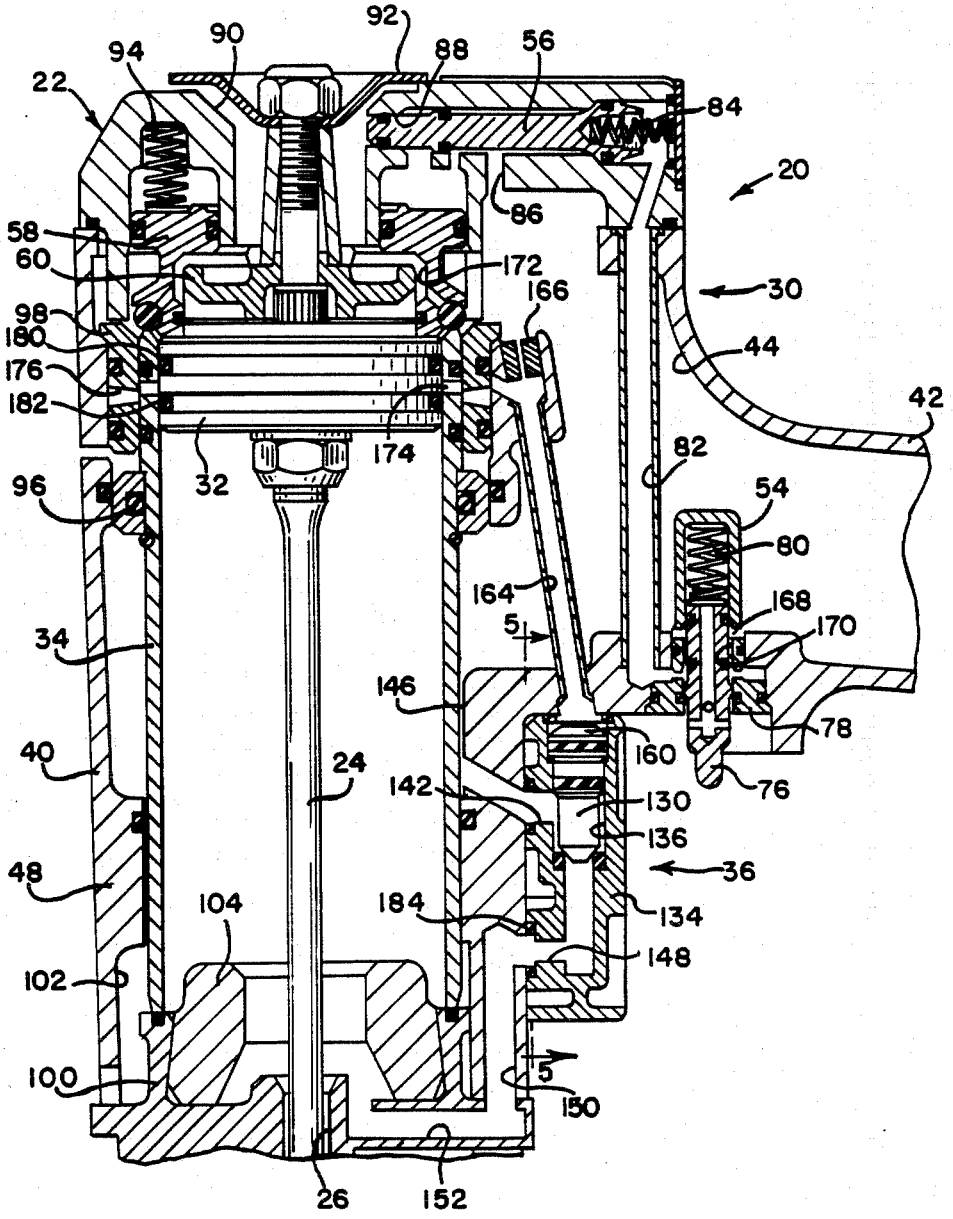
FIG. 3 is a somewhat diagrammatic sectional view of portions of the tool of FIG. 1.

Pneumatic control system 30 includes a trigger valve (FIGS. 3, 4 and 6) and, as best seen in FIGS. 2 and 3 a dump valve 56, a poppet 58 and an exhaust seal 60. In many respects, the pneumatic drive arrangement of tool 20 including the pneumatic control system 30 is similar to that of the fastener driving tool disclosed in U.S. Pat. No. 4,319,705. The disclosure of that patent is incorporated herein by reference for a detailed description of these elements sent invention.

The components of tool 20 are illustrated in the accompanying drawings in a static mode ready to begin a fastener driving operation. A fastener driving cycle is initiated by trigger valve 54 when the tool is placed in contact with a workpiece and when a trigger 62 is pivoted by the user of the too.

Figure 7:
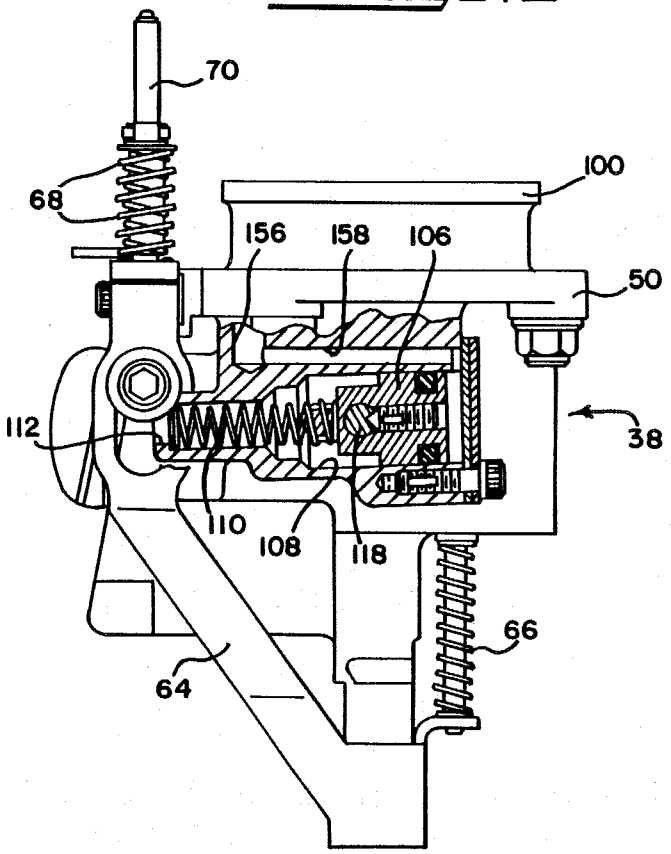
FIG. 7 is an elevational view of the nose portion of the fastener driving tool of FIG. 1 with portions broken away and showing in section portions of the fastener feed assembly of the tool.

More specifically, when the tool is placed against a workpiece into which a fastener 28 is to be driven, a yoke assembly 64 (FIGS. 2 and 7) is shifted upwardly relative to body 40 against the force of yoke bias springs 66 and 68. As a result, a push rod 70 rotates a trip lever 72 (FIG. 6) pivotally mounted to the trigger 62.

When trigger 62 is moved about its axis defined by a trigger pin 74 simultaneously with engagement of the tool with a workpiece, the trip lever 77 engages a trigger valve member 76. The trigger valve member 76 moves upwardly within a trigger valve cartridge 78 against the force of a trigger valve spring 80. This movement controls the operation of the dump valve 56 and poppet 58 to effect a fastener driving operation.

More specifically, movement of valve member 76 to its operated position results in the venting to atmosphere of a dump valve conduit or tube 82 through internal conduits formed in the trigger valve member 76. As a result, the dump valve 56 moves from its static position shown in FIGS. 2 and 3 to the right against the force of dump valve bias spring 84. This movement results from the application of pressure to the dump valve 56 from reservoir 44 through a pressure fluid passageway 86.

When the dump valve 56 moves to the right, it opens an exhaust passage 88 leading from the region above the poppet 58 to an exhaust port 90 partly covered by an exhaust deflector 92. Since the underside of poppet 58 communicates directly with the fluid pressure reservoir 44, the poppet moves upwardly against the force of one or more poppet springs 94.

The initial segment of upward movement of poppet 58 is accompanied by upward movement of cylinder 34. A cylinder bias ring 96 carried by the cylinder 34 is exposed to fluid pressure within the reservoir 44. Thus, the cylinder 34 and bias ring 96 move upwardly together with the poppet until stopped by engagement of the bias ring with a cylinder sleeve member 98. This movement separates the lowermost end of the cylinder 34 from a seal carried by a bumper retainer portion 100 of housing 22. Hence, an unrestricted flow path is opened form the region of cylinder 34 below the drive piston 32 to atmosphere through vent passages 102 in head portion 48.

After upward movement of the cylinder 34 is stopped, the poppet 58 continues to move upwardly into engagement with the exhaust seal 60. This isolates the region above the drive piston 32 from the exhaust port 90. As the poppet 58 separates from the cylinder 34, pressure fluid from the reservoir 44 enters freely below the poppet 58 to the upper portion of the cylinder 34. As a result, the drive piston 32 and the attached driver blade 24 move abruptly and forcefully downward in a fastener driving stroke.

During the fastener driving stroke, the driver blade 24 moves downwardly through the drive track 26 and drives a fastener 28 into the workpiece against which the tool 20 is positioned. Air below the drive piston 32 exits from cylinder 34 below the lower end of the cylinder and through vent passages 102. At the end of the drive stroke, the drive piston 32 engages and is resiliently stopped by an elastomeric bumper member 104 retained in head portion 48 by the bumper retainer 100. Following a drive stroke, the drive piston 32 and driver blade 24 remain in their lowermost position until a return stroke is initiated by release of the trigger 62 and/or by lifting of the tool 20 from the workpiece.

The return system 36 of the present invention operates following a drive stroke to efficiently and rapidly produce a return stroke and also to operate the fastener feed assembly 38 in order to advance a subsequent fastener 28 into the drive track 26. The fastener feed assembly 38 (FIG. 8) is a pressure fluid operated mechanism and may, for example, be similar to that disclosed in U.S. Pat. No. 3,543,987. The disclosure of that patent is incorporated herein by reference for a detailed description beyond that necessary for an understanding of the present invention.

Figure 8:
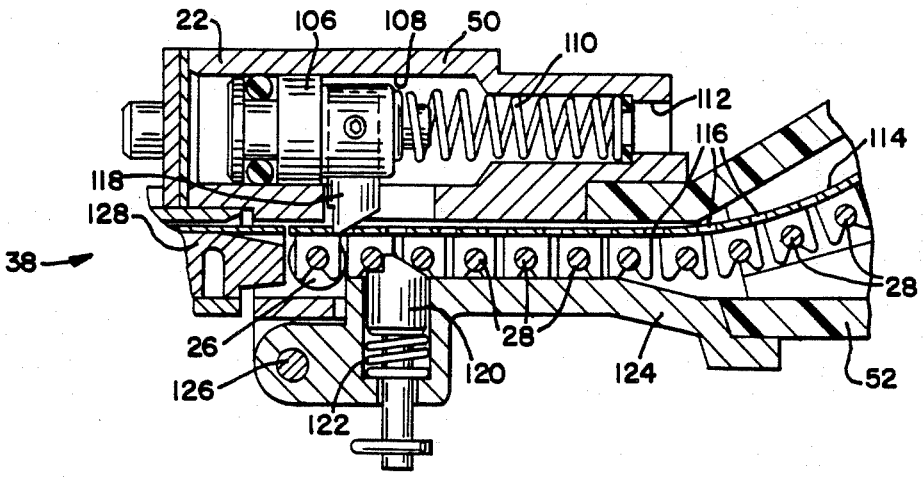
FIG. 8 is a sectional view of the fastener feed assembly of the tool taken along the line 8—8 of FIG. 2.

Having reference now to FIG. 8, the fastener feed assembly includes a fastener feed piston 106 movable in a cylinder 108. Normally the feed piston is held in its illustrated position by a spring 110 engaging one end of the feed piston 106. This end of the piston is vented to atmosphere through a vent port 112 formed in the nose member 50. When the opposite end of the fastener feed piston 106 is pressurized with pressure fluid from the reservoir 44, the piston is moved from the left (FIG. 8) to the right against the force of spring 110 to a cocked position.

While principles of the present invention are applicable to tools for driving a variety of fasteners supplied in many ways, in the illustrated arrangement, fasteners 28 are round head nails supplied from magazine 52 along a feed path in collated fashion by a carrier strip 114. The magazine 52 and carrier strip 114 may be of the type described in detail in U.S. Pat. No. 3,543,987, incorporated herein by reference.

Carrier strip 114 includes a series of feed openings 116 sequentially engageable by a feed pawl 118 carried by the fastener feed piston 106. The arrangements of the openings 116 and pawl 118 is such that in the illustrated static position of the piston 106, the fastener 28 next to be driven by tool 20 is precisely positioned in drive track 26 in alignment with driver blade 24.

When fluid pressure is applied to piston 106, feed pawl 118 moves in a cocking stroke along the carrier strip 114 and engages the next feed opening 116. A back-up pawl 120 biased by a spring 122 toward fasteners 48 engages the next to be driven fastener during movement of the feed pawl 118 to prevent reverse movement of the strip 114.

After feed pawl 118 has moved to its cocked position and fluid pressure to the feed piston 106 is discontinued, the feed piston spring 110 moves the feed piston 106 (to the left as illustrated in FIG. 8) in order to advance the carrier strip 114 one increment thereby to align the next fastener 28 in the drive track 26. Back-up pawl 120 is shaped with a cam surface to permit this feeding movement of the strip 114.

Access is provided to the interior of the fastener feed assembly 38 by means of a door 124 normally latched in the illustrated closed position. This door may be opened by pivoting around a pivot pin 126 to withdraw the back-up pawl 120 away from the carrier strip 114. Strip 114 emptied of fasteners 48 is guided away from the drive track 26 by an exit guide structure 128 supported upon the nose member 50.

At the completion of a fastener drive stroke, the drive piston 32 is returned in a return stroke to the static position before another fastener 28 is driven. Return system 36 serves to apply fluid pressure from reservoir 44 to the underside of drive piston 32 in order to cause this return stroke. Before the next drive stroke occurs, the fastener feed assembly 38 operates to advance the next fastener 28 to the drive track 26. The return system 36 of the present invention also introduces pressure fluid from reservoir 44 to the fastener feed assembly 38 to carry out a fastener feed operation.

It is desirable that the tool 20 be prepared as rapidly as possible for the next fastener driving operation because reduced cycle times permit more economical and efficient use of the tool 20. It has been difficult to achieve short cycle times in the past because of the different system requirements of the drive piston return stroke and the fastener feed operation. In order to return the drive piston, a relatively high quantity of air at a relatively low pressure (for example, 5 PSI) is necessary. However, the pressure fluid requirements of the fastener feed assembly 38 are very different due to the spring force of the fastener feed spring 122. This spring must be sufficiently strong to assure reliable advance of the carrier strip 114 from the magazine 52 despite friction, weight of the carrier strip and the like. Since spring 122 is relatively strong, a relatively small quantity of high pressure fluid (for example, 60 PSI) is required to operate the fastener feed assembly 38. The return system 36 of the present invention satisfies the different fluid pressure and flow requirements of the return stroke and the fastener feed operation, and does so in a minimum of time with a maximum of reliability in operation.

Referring more specifically to the return system 36, both a drive piston return valve 130 and a feed piston return valve 132 are provided. Each return valve 130 and 132 includes its own independent and separate valve member mechanically independent of the other. As a result, the operation of each return valve can be specifically tailored to the pressure fluid requirements of the piston return stroke and the fastener feed stroke respectively.

Figure 4:
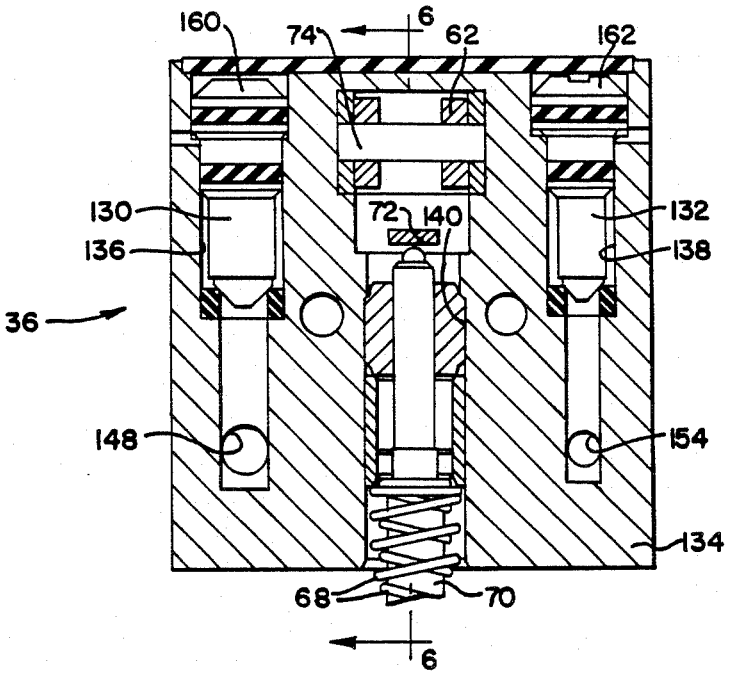
FIG. 4 is a sectional view of part of the return system of the tool taken along the line 4—4 of FIG. 2.

Valves 130 and 132 are mounted in a return valve housing 134 attached to the head portion 48 of body 40 beneath handle 42. Bores or cylinders 136 and 138 are formed in housing 134 respectively to receive the return valves 130 and 132. The bores 136 and 138 are disposed at opposite sides of a passage 140 in which the yoke assembly push rod 70 is received (FIG. 4).

Each return valve 130 and 132 includes an inlet passage 142 and 144 respectively formed in the housing 134. A clearance 146 between the housing 134 and the cylinder 134 provides continuous and relatively unrestricted communication between the fluid pressure reservoir 44 and the return valve inlets 142 and 144. An outlet passage 148 is formed in the return valve housing 134 for the drive piston return valve 130. This passage is in unrestricted communication with the underside of the drive piston 32 by means of additional passages 150 and 152 formed in the housing 22 and leading to the open interior region of the bumper 104 (FIG. 3).

Figure 9:
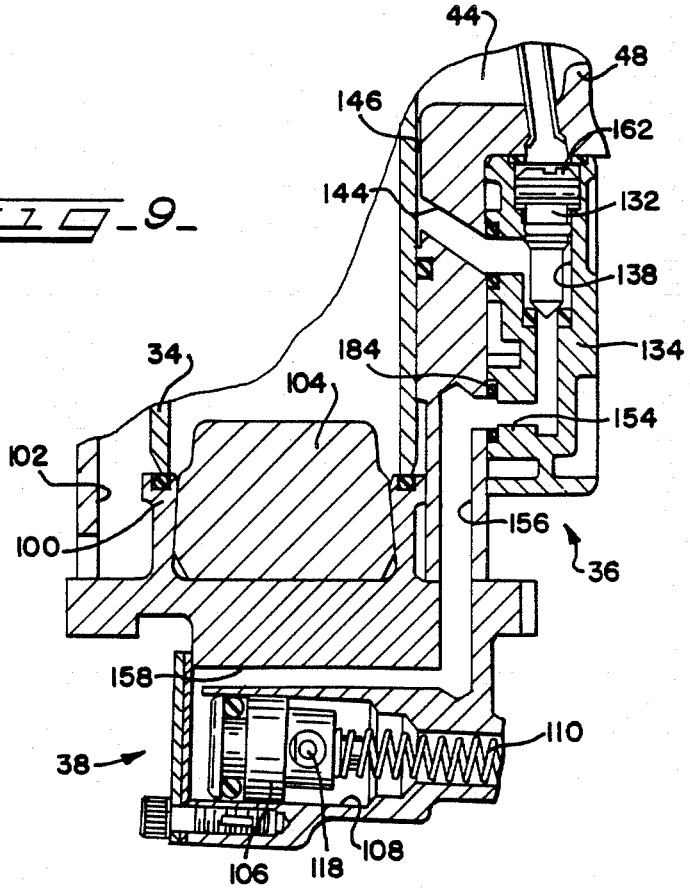
FIG. 9 is a somewhat diagrammatic sectional view of portions of the return system and fastener feed assembly of the tool of FIG. 1.

An outlet passage 154 of the feed piston return valve 132 is also formed in the return valve housing 134. This passage is in continuous communication by way of additional passages 156 and 158 with the fastener feed piston 106 and cylinder 108 (FIG. 9).

In the static condition illustrated in the drawings, both the drive piston return valve and the feed piston return valve are maintained in a closed condition with the inlets 142 and 144 isolated from the outlets 148 and 154. Each return valve 130 and 132 includes a pressure sensing portion 160 and 162 respectively in the form of an enlarged valve portion movable in an enlarged portion of the respective bore 136 or 138. Normally relatively high pressure is applied to the sensing portions 160 and 162 by communication with the fluid pressure reservoir 44 by way of a pressure conduit or tube 164 and a restricted orifice plug 166.

Pressure normally present at these sensing portions 160 and 162 normally maintains the return valves 130 and 132 closed. The area differential of the sensing portion 160 with respect to the outlet 148 of the drive piston return valve 130 is relatively small. However, this differential is ample to insure closing of the drive piston return valve 130 against the relatively low outlet pressures experienced by this valve.

The area differential of the feed piston return valve 132 between its sensing portion 162 and its outlet 154 is substantially larger. This larger pressure differential assures reliable closure of the feed piston return valve 132 even though it is subject to substantially higher output pressures than is the drive piston return valve 130. Thus, the use of two mechanically independent and separate valves permits the valves to be tailored for reliable and simultaneous closure even though different output pressure conditions exist.

Figure 6:
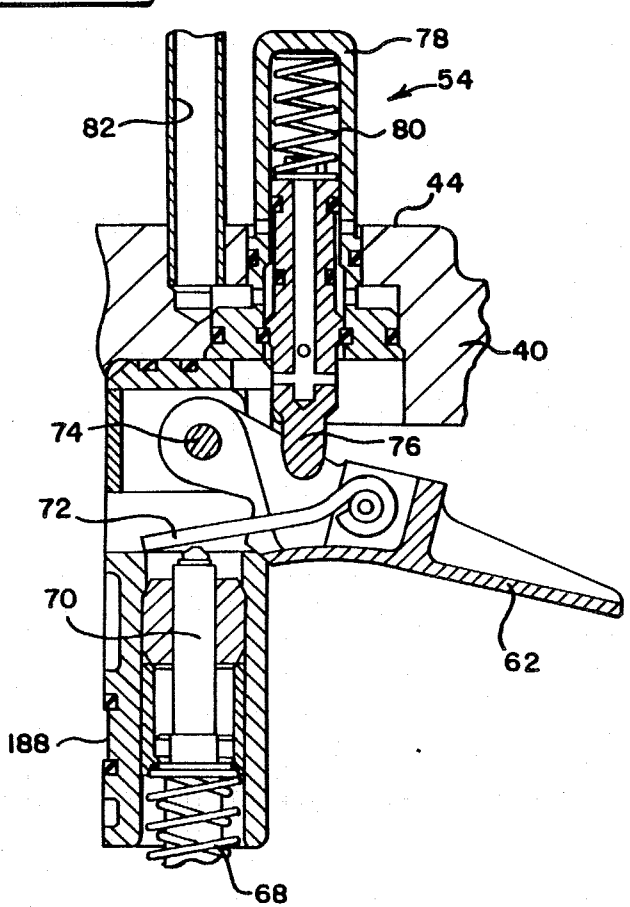
FIG. 6 is a sectional view taken along the line 6—6 of FIG. 4 and illustrating the trigger valve assembly of the tool.

The return system 36 comes into operation following a drive stroke. When the trigger 62 and/or the yoke assembly 64 is released following a drive stroke, the trigger valve member 76 returns due to the force of the spring 80 to its illustrated non operated condition. As a result, the dump valve tube 82 is no longer vented to atmosphere. Instead, the conduit 82 is connected to the fluid pressure reservoir 44 through passages 168 in the trigger valve cartridge 78 and a clearance 170 provided between the trigger valve member 76 and the interior of the cartridge 78 (FIG. 6).

When the dump valve conduit 82 is pressurized, the dump valve 56 returns to its closed position as illustrated in the drawings. Consequently, the exhaust passage 88 is closed and communication is established from the pressure fluid passageway 86 along the dump valve 56 to the region above the poppet 58.

When fluid pressure is applied to the upper surface of the poppet 58, the poppet moves downwardly into contact with the top of the cylinder 34. Due to the pressure area differential between the poppet 58 and the bias ring 96, both the poppet 58 and the cylinder 34 continue to move downwardly until the lower end of the cylinder 34 is in sealing engagement with the bumper retainer 100. In this lowermost position of the poppet 58 as illustrated in the drawings, an exhaust path 172 is opened around the periphery of the exhaust seal 60. Thus, the region above the drive piston 32 within cylinder 34 communicates freely with atmosphere through the exhaust port 90.

In the illustrated lower position of cylinder 34, ports 174 in the cylinder wall communicate with passages 176 in the cylinder sleeve 98. These passages 176 communicate in turn with a passage 178 communicating with the return system tube or conduit 164 at a pressure sensing region between the orifice plug 166 and the sensing portions 160 and 162 of the return valves 130 and 132. Consdequently, at the beginning of a return stroke when the vent passage 172 is open and the drive piston 132 has not returned to its static position, the pressure in the tube 164 to which the pressure sensing portions 160 and 162 are exposed drops abruptly. For this reason, at the beginning of a return stroke, the drive piston and feed piston return valves 130 and 132 move form their illustrated closed positions to their alternate open positions.

Opening of the drive piston return valve 130 interconnects its inlet 142 with its outlet 148, thus connecting the pressure fluid reservoir 44 to the underside of the drive piston 32. As a result, the drive piston rapidly moves upwardly in a return stroke toward the static position.

Simultaneously, opening of the feed piston return valve 132 interconnects its inlet 144 with its outlet 154 to interconnect the fluid pressure reservoir 44 with the fastener feed piston 106. As a result, the feed piston 106 moves in a cocking stroke in preparation for feeding of the next fastener 28.

When the drive piston 32 returns to its static position illustrated in the drawings, ports 174 are isolated by a pair of seals 180 and 182 carried by the drive piston 32. Hence, bleeding or venting of pressure from the return system tube or conduit 164 is discontinued and the pressure applied to the return valve sensing portions 160 and 162 increases. This causes both valves to move from their open positions to their illustrated closed positions. Since the two independent and separate return valves 130 and 132 can be tailored for their separate system requirements, it can be assured that both valves close quickly and essentially simultaneously.

Following closing of the return valves 130 and 132 when the drive piston 32 returns to its static position, the feed piston spring 110 moves the fastener feed piston 106 and feed pawl 118 to advance the next fastener 28 into the drive track 26 beneath the driver blade 24. In order to increase the speed of the fastener feeding operation, the return system 36 dissipates pressure trapped between the drive piston return valve 130 and the fastener feed piston 106.

Figure 5:
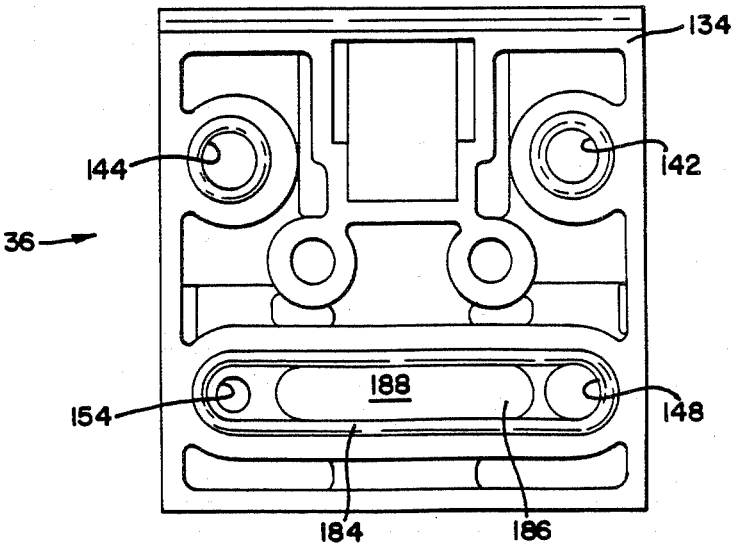
FIG. 5 is an elevational view of the return valve housing of the fastener driving tool taken from the line 5—5 of FIG. 3.

More specifically, the outlets 148 and 154 formed in the return valve housing 134 are sealed by a single seal member 184 of elongated or oval shape (FIG. 5). A restricted passage 186 communicates between the outlets 148 and 154. In the illustrated arrangement, this restricted passage is provided by a slight clearance between a surface 188 of the return valve housing 134 and the adjacent portion of the tool housing 22 (FIGS. 5 and 6). If desired, a restricted passage for pressure dissipation of the feed piston return valve 132 may be provided in other ways. The restriction of the pressure dissipation passage is such that it does not prevent the rapid attainment of ample pressure for operation of the fastener feed assembly 38 when the feed piston return valve 132 is open.

In the static position of the tool, even though the cylinder 34 is in its lowermost position, there exists some clearance along the drive track 26 between the cylinder 34 and atmosphere. This clearance is more than ample to permit dissipation of pressure at the outlet side of the feed piston return valve 132 through the restricted passage 186 and the passages 150 and 152.

While the present invention has been described with reference to details of the embodiment illustrated in the drawing, these details are not intended to limit the scope of the invention as defined in the following claims.

We claim:

1. A fastener driving tool comprising a pressure fluid reservoir, a drive piston, a fastener feed piston, valve means to connect the reservoir to the drive piston to effect a fastener drive stroke, and a pressure fluid return system for returning the drive piston and operating the feed piston at the end of a drive stroke, said return system comprising in combination:

a drive piston return valve having an inlet connected to the reservoir and an outlet connected to the drive piston; and a feed piston return valve having an inlet connected to the reservoir and an outlet connected to the fastener feed piston.

2. A system as claimed in claim 1 wherein the flow capacity of said drive piston return valve is larger than the flow capacity of said feed piston return valve.

3. A system as claimed in claim 1 wherein said outlets are substantially isolated from one another for drive piston return and fastener feed piston actuation at different pressures.

4. A system as claimed in claim 1 further comprising a restricted bypass connected between said outlets for dissipation of fastener feed piston back pressure following closing of said feed piston return valve.

5. A fastener driving tool including a housing defining a reservoir for pressurized fluid, a cylinder, a drive piston movable in said cylinder, a driver carried by the drive piston and movable along a drive path, fastener feeding means for advancing a fastener into the drive path, valve means for connecting a first side of said drive piston to the reservoir for moving the drive piston and driver in a drive stroke, and the improvement comprising a first return valve for connecting said reservoir to the second side of said drive piston for moving the drive piston and driver in a return stroke to a static position and a second return valve for connecting the reservoir to said fastener feeding means.

6. The fastener driving tool of claim 5 further comprising valve control means for closing said first and second return valves when said drive piston is in the static position and for opening said first and second return valves during a return stroke of the drive piston.

7. The fastener driving tool of claim 5 further comprising a restricted bleed path extending between the outlets of said first and second return valves.

8. A pneumatic fastener driving tool comprising in combination:

a housing defining a pressure fluid reservoir, a fastener drive track and a fastener feed path;

a pressure fluid actuated fastener feed assembly for advancing fasteners along said fastener feed path to said drive track;

a driver blade movable in said drive track for driving fasteners into a workpiece;

a cylinder in said housing;

a drive piston connected to said driver blade and movable in said cylinder from a static position in a fastener drive stroke and movable back to said static position in a return stroke;

a pneumatic control system for connecting a first side of said drive piston to said reservoir during a drive stroke and for venting said first side of said drive piston during a return stroke;

a return system for connecting said reservoir to the second side of said drive piston to effect a return stroke and for connecting said reservoir to said fastener feed assembly to effect feeding of a fastener; and the improvement in accordance with which the return system includes;

a drive piston return valve having an outlet connected to the second side of said drive piston;

a fastener feed return valve having an outlet connected to said fastener feed assembly;

inlets of both said return valves connected to said reservoir; and a return valve control system for opening both said return valves following a drive stroke and for closing both said return valves in the static position of said drive piston.

9. The combination claimed in claim 8, said return valve control system including a control pressure region, and each said return valve including a movable valve member having a pressure sensing portion communicating with said control pressure region.

10. The combination claimed in claim 9, said return valve control system further comprising a restricted flow path extending from said control pressure system to said reservoir, a vent passage extending from said control pressure region, means for opening said vent passage during a drive piston return stroke, and means for closing said vent passage in the static position of said drive piston.

11. The combination claimed in claim 10, said vent passage extending through said cylinder and said drive piston blocking said vent passage in the static position.

12. The combination claimed in claim 9 wherein said pressure sensing portions are of different sizes.

13. The combination claimed in claim 8 wherein said return valves have different flow capacities.

14. The combination claimed in claim 8 wherein the operating pressure requirement of said fastener feed assembly exceeds the pressure required to move said drive piston in a return stroke.

15. The combination claimed in claim 8, said fastener feed assembly including a pawl, a feed piston for moving said pawl, biasing means for moving said feed piston in a fastener feeding direction, and passage means extending between said fastener feed return valve and said feed piston for moving said feed piston in a cocking stroke against the force of said biasing means in response to opening of said fastener feed return valve.

16. The combination of claim 15 further comprising a bleed passage communicating with said feed piston for dissipating pressure in said passage means following closing of said fastener feed return valve.

17. The combination of claim 16, said bleed passage comprising a restricted passage connected between the outlets of said drive piston return valve and said fastener feed return valve.

* * * * *